US006244629B1

(12) United States Patent
Chess

(10) Patent No.: US 6,244,629 B1
(45) Date of Patent: Jun. 12, 2001

(54) COMBINATION SHIPPING LABEL/INVOICE FORM

(75) Inventor: Stanley C. Chess, Goffstown, NH (US)

(73) Assignee: Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/541,930

(22) Filed: Apr. 3, 2000

(51) Int. Cl.[7] ..... B42D 15/00

(52) U.S. Cl. ..... 283/66.1; 283/79; 283/80; 283/81

(58) Field of Search ..... 283/101, 105, 283/79, 80, 81; 428/40.1, 41.7, 41.8, 42.2, 42.3, 43, 44

(56) References Cited

U.S. PATENT DOCUMENTS 3,743,323 * 7/1973 Houss ..... 281/21.1
4,696,843 * 9/1987 Schmidt ..... 281/5
4,955,640 9/1990 Anderson .
5,031,939 7/1991 Webendorfer et al. .
5,071,167 12/1991 O'Brien .
5,098,759 3/1992 Felix .
5,209,698 5/1993 Dolan .
5,413,383 5/1995 Laurash et al. .
5,484,170 1/1996 Hatfield, Jr. .
5,509,694 4/1996 Laurash et al. .
5,601,313 * 2/1997 Konkol et al. ..... 283/81

* cited by examiner

*Primary Examiner*—Willmon Fridie, Jr.
(74) *Attorney, Agent, or Firm*—Simpson Simpson & Snyder LLP

(57) ABSTRACT

A combination shipping label/invoice form, including a shipping label section detachably secured along a dividing border to an invoice section, the shipping label section bordered at a first edge by a first marginal strip and at a second edge by a second marginal strip, the invoice section bordered by a third edge and a fourth edge, the shipping label section being wider between the first and second edges than the invoice section between the third and fourth edges, such that folding the invoice section along the dividing border and against the shipping label section results in the invoice section lying between the first and second edges of the shipping label section, where the lower side of the first and second marginal strips is coated with adhesive.

6 Claims, 11 Drawing Sheets

COMBINATION SHIPPING LABEL/INVOICE FORM

FIELD OF THE INVENTION

This invention relates generally to business forms and, more particularly, to packing slip and shipping label forms and, even more specifically, to a combination shipping label/invoice form.

BACKGROUND OF THE INVENTION

Shipping labels are commonly used to ship packages from a sender to a recipient. All shipping labels include a section for the designation of addressor/sender and a section for the designation of addressee/recipient. Usually, shipping labels are adhesive-backed in order that they may be secured to the package being sent.

An invoice is a business form used to indicate the quantity and description of products or services tendered, in combination with a request for payment of the same.

Quite often, products are shipped in packages bearing shipping labels, and invoices are mailed separately at a later time. Sometimes, an invoice in enclosed within the package being sent. Both of these methods, however, require additional printing and/or handling by the sender.

Others have created business forms having multiple parts and/or purposes. U.S. Pat. No. 5,509,694 (Laurash et al.), for example, discloses a tri-fold label or business form containing panels suitable for invoices, receipts and shipping labels. The patented form includes a Z-fold separating the three form sections.

U.S. Pat. No. 5,484,170 (Hatfield, Jr.) discloses a unitary shipping label, product information label and packing slip.

U.S. Pat. No. 5,413,383 (Laurash et al.) discloses a multipurpose tuck label/form U.S. Pat. No. 5,071,167 (O'Brien) relates to a shipping and return mailing label. The patented form is tripartite and comprises a Z-fold.

Despite the teachings of the prior art, no one has of yet invented a simple pressure sensitive combination shipping label/invoice form which permits printing of both forms in a single operation and then adherence to a package as an integral form, displaying outwardly only the shipping label, thereby minimizing handling and expense.

SUMMARY OF THE INVENTION

The invention broadly comprises a combination shipping label/invoice form, having a first ply having an upper side and a lower side, the first ply comprising a shipping label section detachably secured along a dividing border to an invoice section, the shipping label section bordered at a first edge by a first marginal strip and at a second edge by a second marginal strip, the invoice section bordered by a third edge and a fourth edge, the shipping label section being wider between the first and second edges than the invoice section between the third and fourth edges, such that folding the invoice section along the dividing border and against the shipping label section results in the invoice section lying between the first and second edges of the shipping label section, where the lower side of the first and second marginal strips is coated with adhesive; and, a second ply comprising a release liner detachably secured to the adhesive-coated underside of the first and second marginal strips.

A general object of the invention is to provide a combination shipping label/invoice form which may be printed in a single operation and attached as an integral but detachably separable form to a package.

These and other objects, features and advantages of the invention will become apparent from the following description, drawings and appended claims.

DETAILED DESCRIPTION OF THE PREFERRED EMBODIMENT

At the outset, it should be understood that identical reference numbers on different drawing views identify identical structural elements. Also, although a preferred embodiment of the invention is described herein, it should be apparent that changes and modifications can be made to the invention without departing from the spirit and scope of the invention as claimed.

Figure 1:
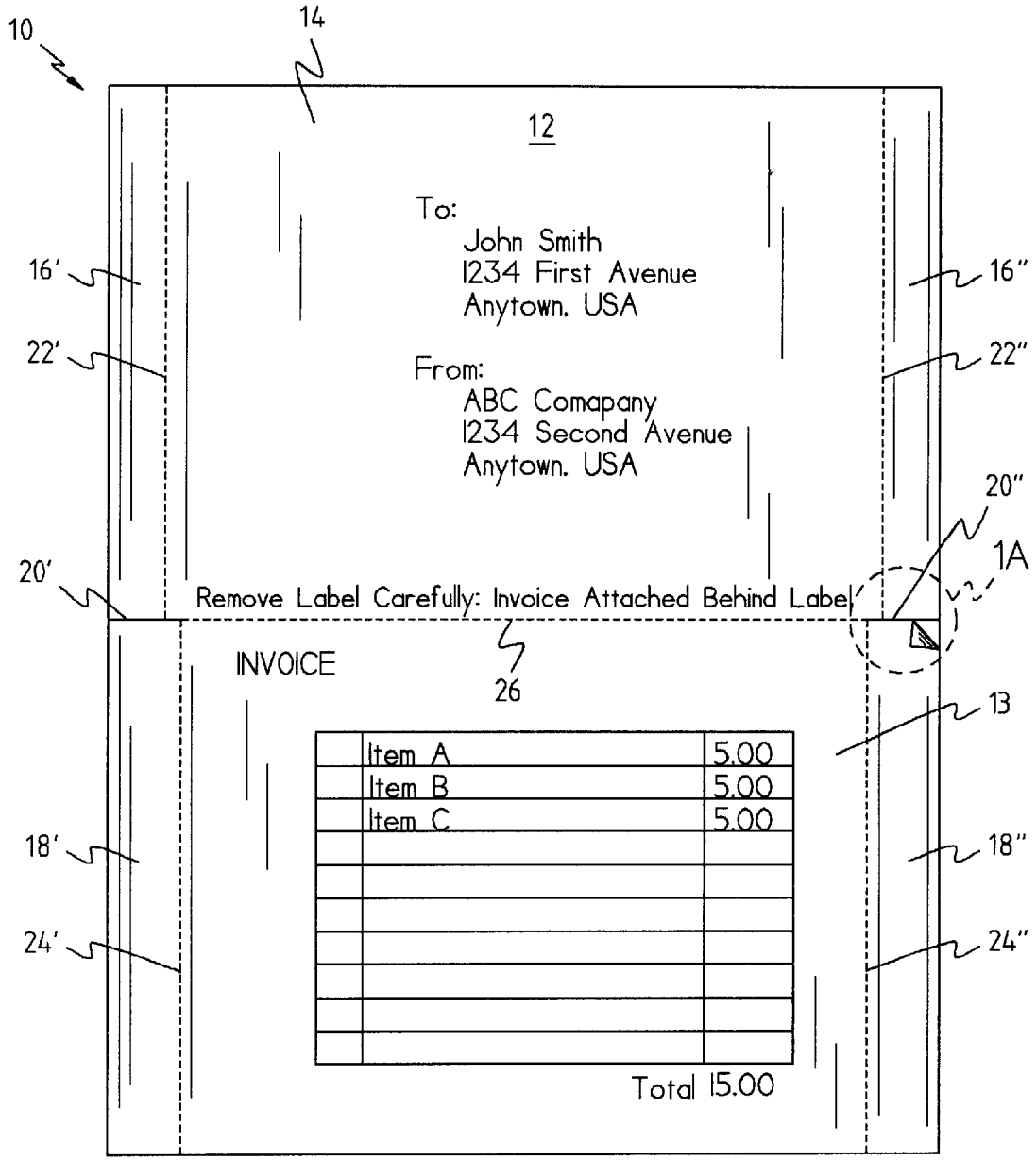
FIG. 1 is a plan view of the pressure sensitive shipping label/invoice form of the invention.

Adverting now to the drawings, FIG. 1 is a plan view of the combination shipping label/invoice form 10 of the present invention. Form 10 is seen broadly to include shipping label section 14 and invoice section 13. In a preferred embodiment, form 10 comprises two plies, with the top ply 12 being shown in FIG. 1. The top ply may be constructed of any suitable substrate, such as paper or card stock. In a preferred embodiment, the underside of the top ply is coated with an adhesive, and preferably a pressure sensitive adhesive. The bottom ply comprises a release liner which, in a preferred embodiment, comprises a silicone coated substrate detachably secured to the adhesive coating.

Shipping label section 12 contains sections suitable for sender and recipient addresses. (These are illustrated as "To:" and "From:" addresses, respectively, in FIG. 1. Label 12 is separated from invoice 13 by perforation 26, which perforates both the top and bottom plies (hereinafter referred to as a "clear through" perforation), and forms a dividing border between the invoice section and shipping label section. Label 12 is bordered by first marginal strip 16' and second marginal strip 16". A clear through top ply perforation 22' defines a first edge of shipping label 12 and separates the shipping label from the first marginal strip. A second clear through top ply perforation 22" defines a second edge of shipping label 12 and separates the label from the second marginal strip. Thus, it is seen that shipping label 12 is bordered by first marginal strip 16', invoice 13, and second marginal strip 16".

Invoice 13 is bordered by third marginal strip 18' and fourth marginal strip 18". A clear through perforation 24' defines a third edge of invoice 13 and separates invoice 13 from third marginal strip 18'. A second clear through perforation 24" defines a fourth edge of invoice 13 and separates invoice 13 from marginal strip 18". It should now be appreciated that the shipping label is wider than the invoice. In other words, the distance between edges 22' and 22" is greater than the distance between edges 24' and 24". This is a critical aspect of the invention. Moreover, as seen in the drawings, when invoice 13 is folded along perforation 26 against shipping label 14, the entire width of invoice 13 will lay between edges 22' and 22". This is also an important part of the invention, as it enables the invoice to be tucked behind the shipping label when attached to a package, and yet the invoice clears the marginal adhesive backed strips 16' and 16".

In a preferred embodiment, the undersides of marginal strips 16', 16", 18' and 18", shipping label 14 and invoice 13 are all coated with an adhesive, and preferably a pressure coated adhesive. However, as will be appreciated from this description of the invention, the adhesive coating on the shipping label, invoice, and marginal strips 18' and 18" is optional. Moreover, the adhesive may be permanent, pressure sensitive, or repositionable.

Figure 1A:
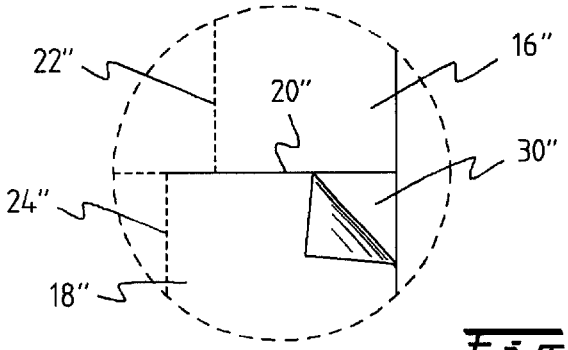
FIG. 1A is an enlarged view of section 1A of the form shown in FIG. 1.

Marginal strip 16' and marginal strip 18' are separated by clear through top ply die-cut 20', and marginal strip 16" and marginal strip 18" are separated by clear through top ply die-cut 20", as shown more clearly in enlarged view in FIG. 1A, which is an enlarged view of the form section labeled 1A in FIG. 1.

Figure 2:
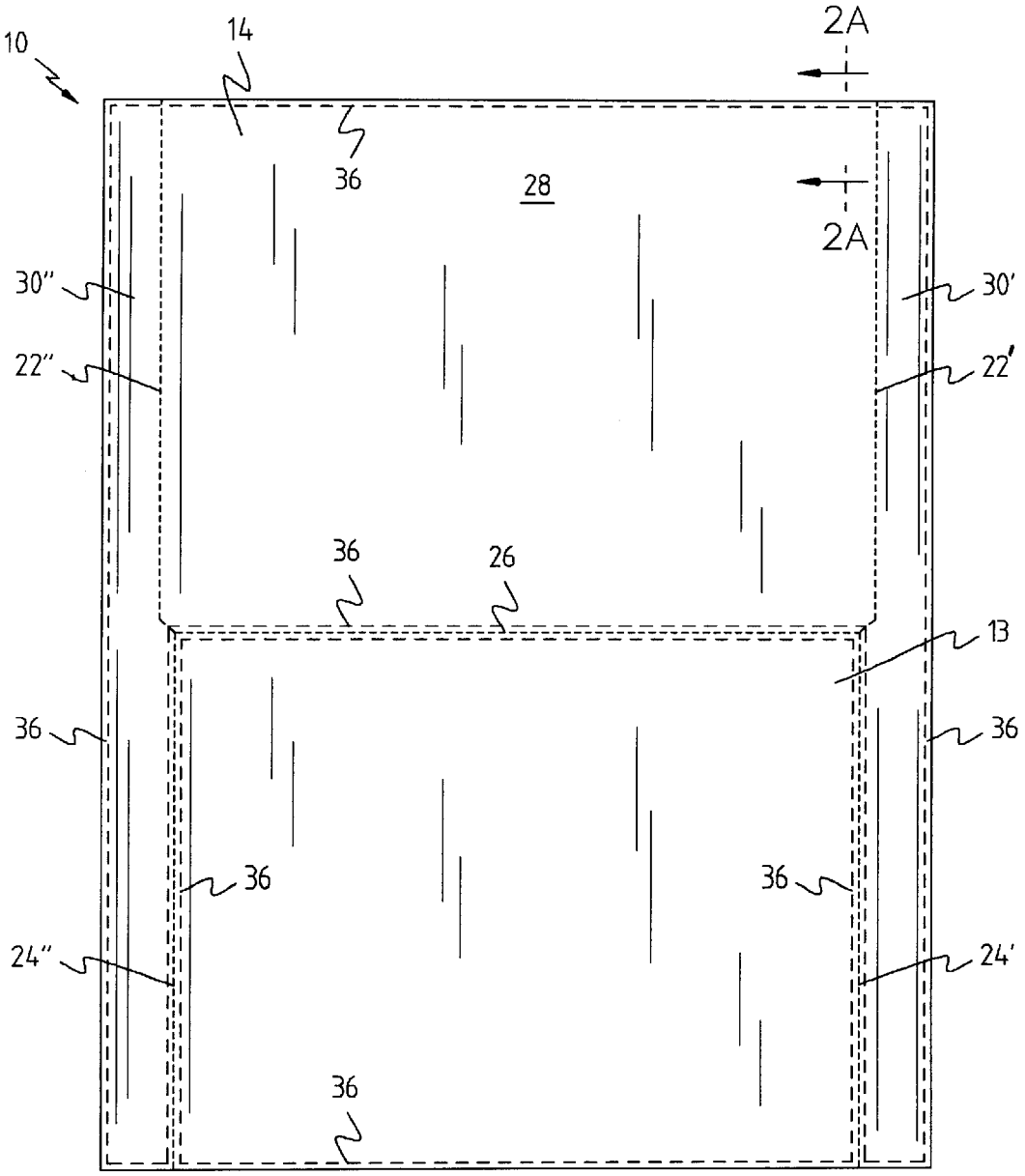
FIG. 2 is a view of the back of the pressure sensitive shipping label/invoice form shown in FIG. 1.

The back of form 10 is shown in plan view in FIG. 2. In this view, silicone release liner 28 is shown covering the entire underside of form 10. Release liner section 30" is detachably secured to adhesive backed marginal strip 16" and 18". Release liner section 30' is detachably secured to adhesive backed marginal strip 16' and 18'. Area 36 represents a un-coated adhesive area of the underside of the top ply, where adhesive is not applied.

Figure 2A:
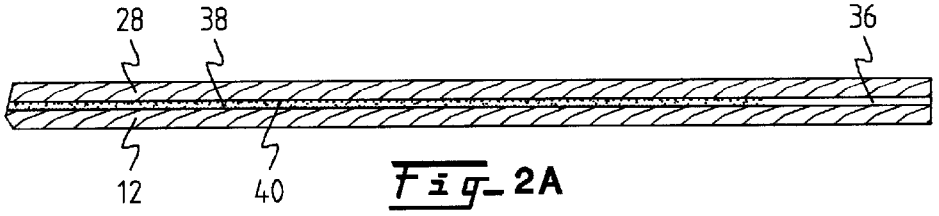
FIG. 2A is a fragmentary cross-sectional view taken generally along line 2A—2A in FIG. 2.

A fragmentary cross-sectional view of a section of the form is shown in FIG. 2A, a view taken generally along line 2A—2A in FIG. 2. This view clearly shows shipping label 12, adhesive layer 38, release liner 28, and silicone coating 40. This view also show un-coated adhesive area 36 where adhesive is void the underside of the label.

Figure 3A:
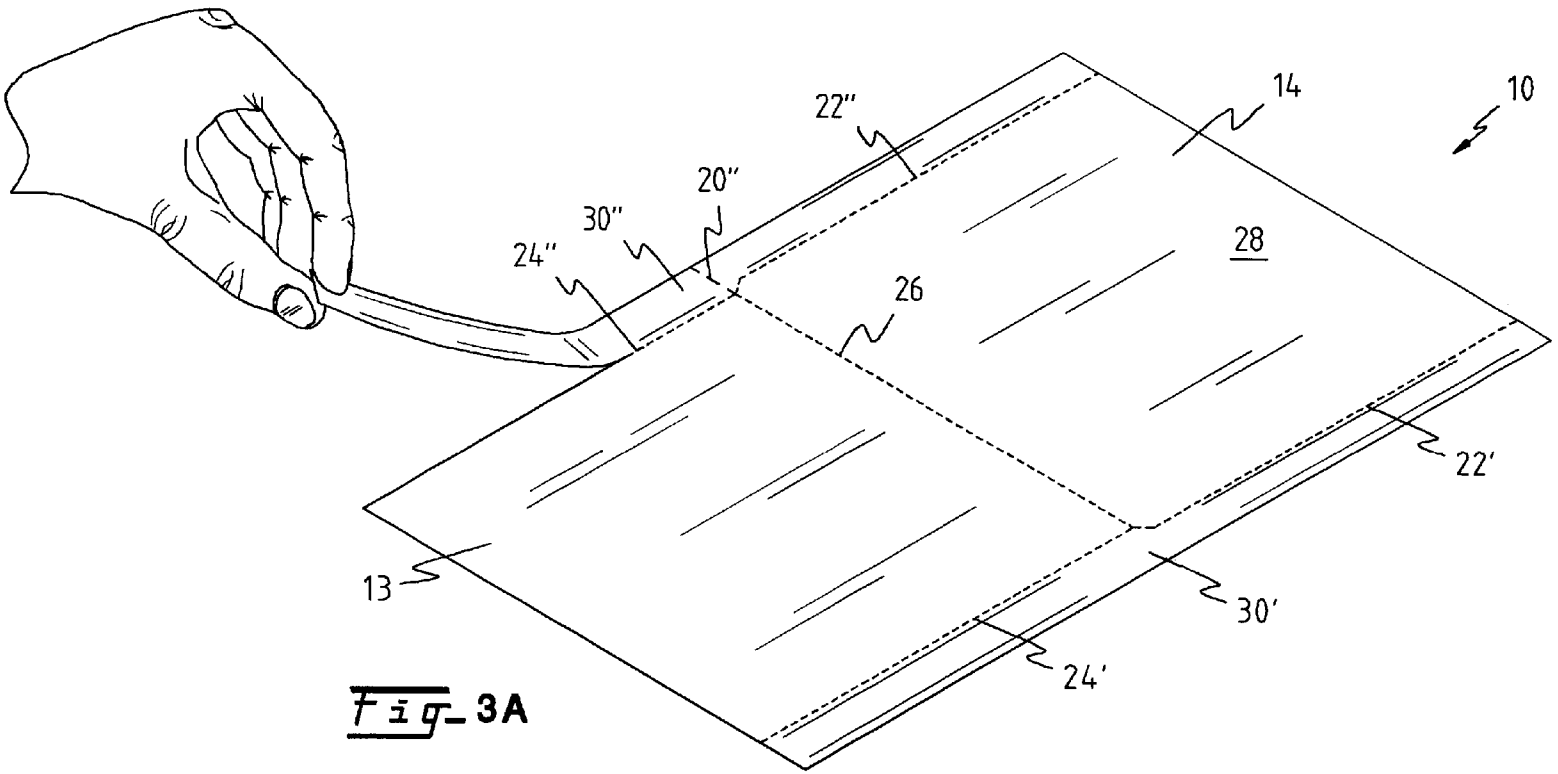
FIG. 3A is a perspective view of the back of the form shown in FIGS. 1 and 2, illustrating removal of marginal strip 18" and release liner 30" from the invoice section of the form.
Figure 3B:
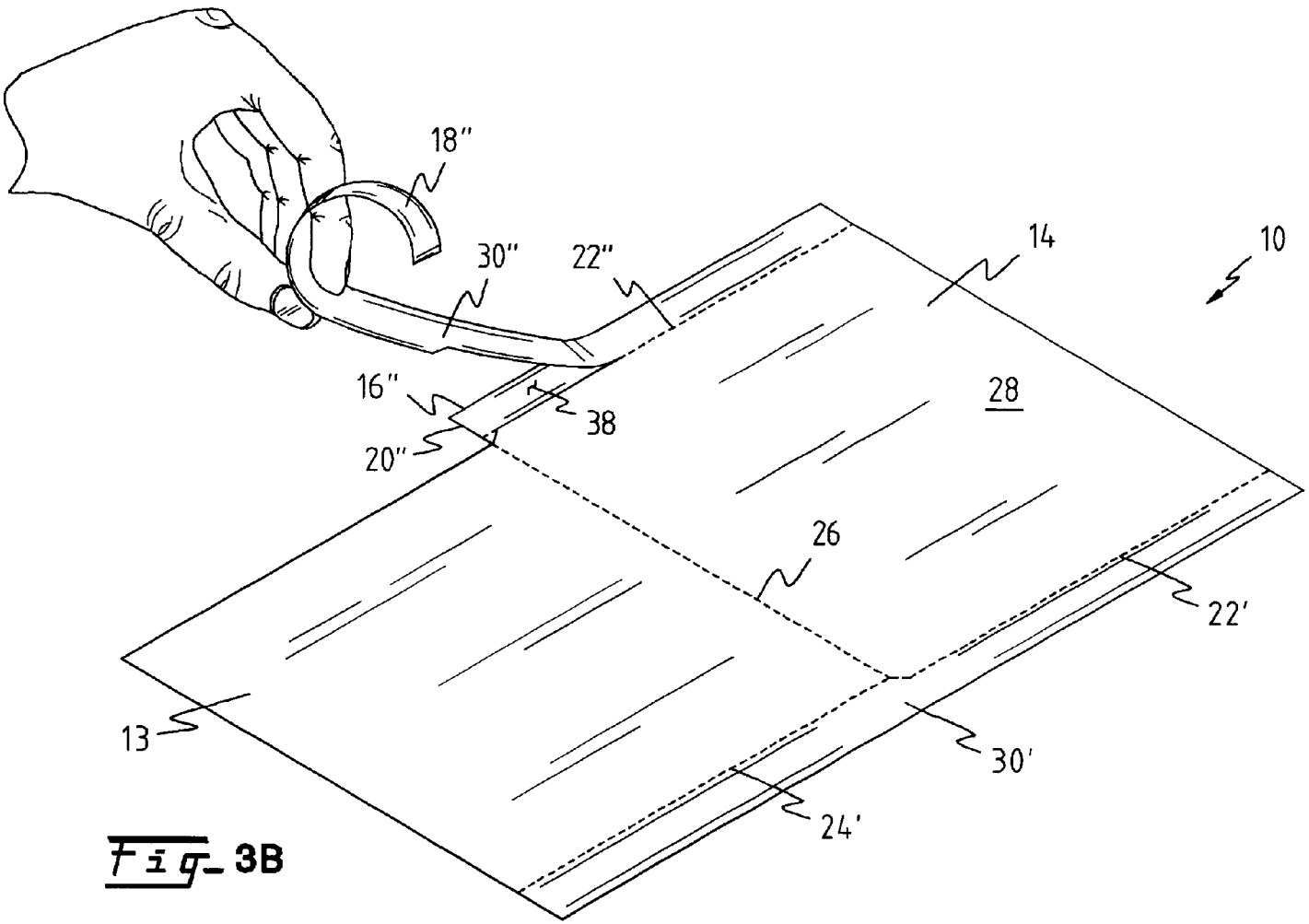
FIG. 3B is a view similar to that of FIG. 3A, illustrating removal of release liner 30" from marginal strip 16" which borders the shipping label section of the form.
Figure 3C:
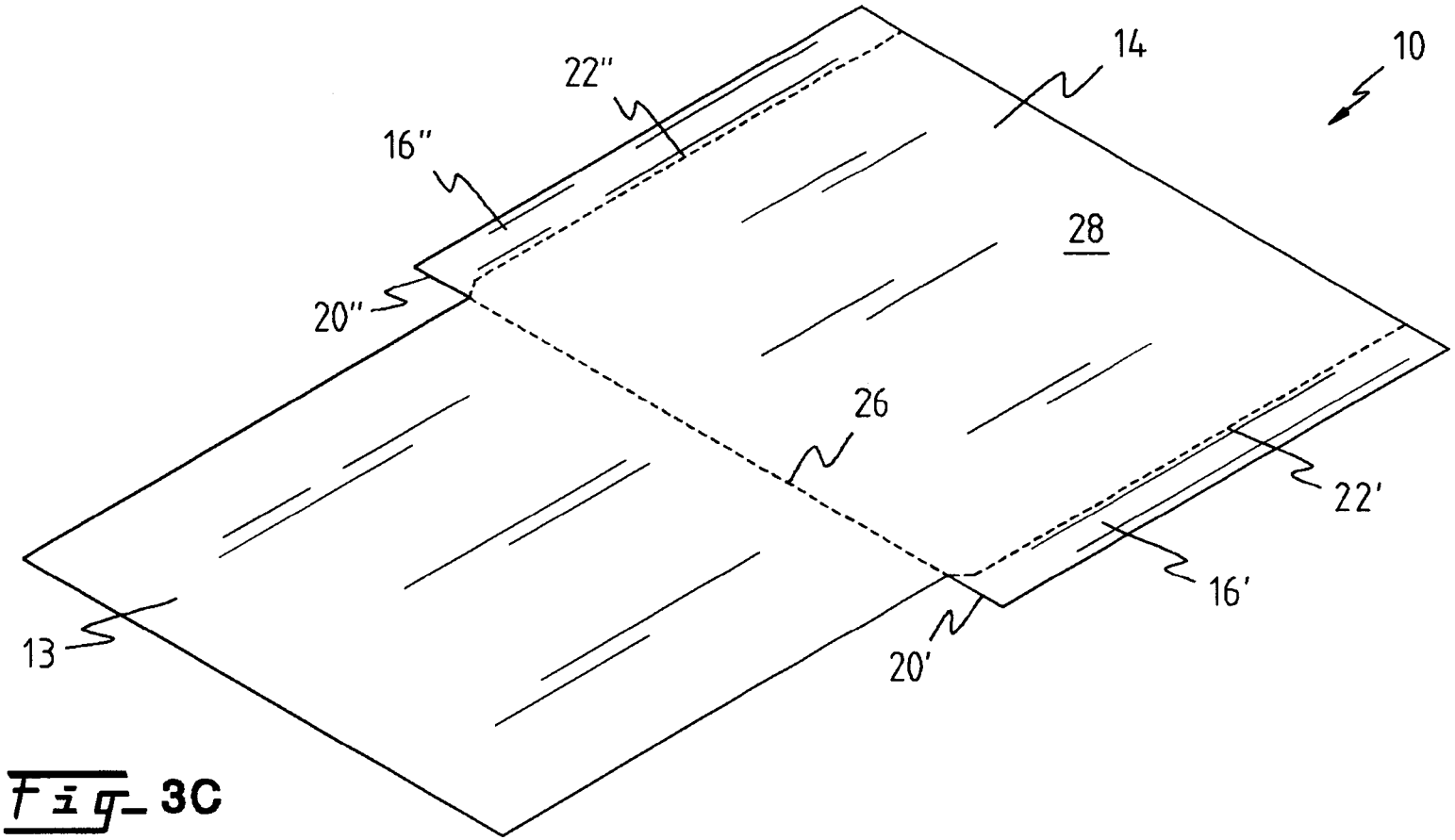
FIG. 3C is a view similar to that of FIG. 3B, illustrating the back of the form after the invoice marginal strips and the marginal strip release liner sections have been removed.
Figure 3D:
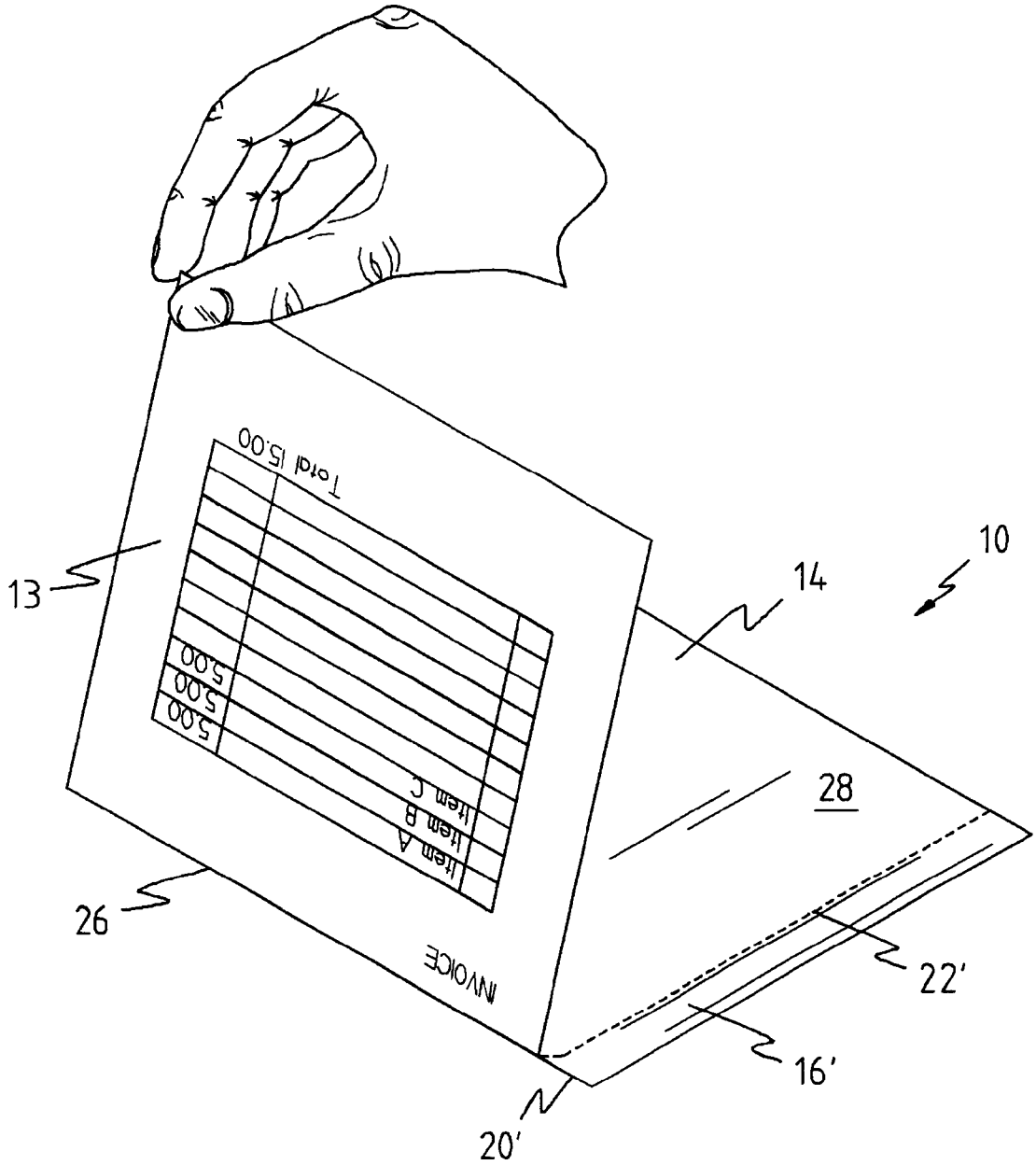
FIG. 3D is a perspective view of the form illustrating folding of the invoice section behind the shipping label section.
Figure 4:
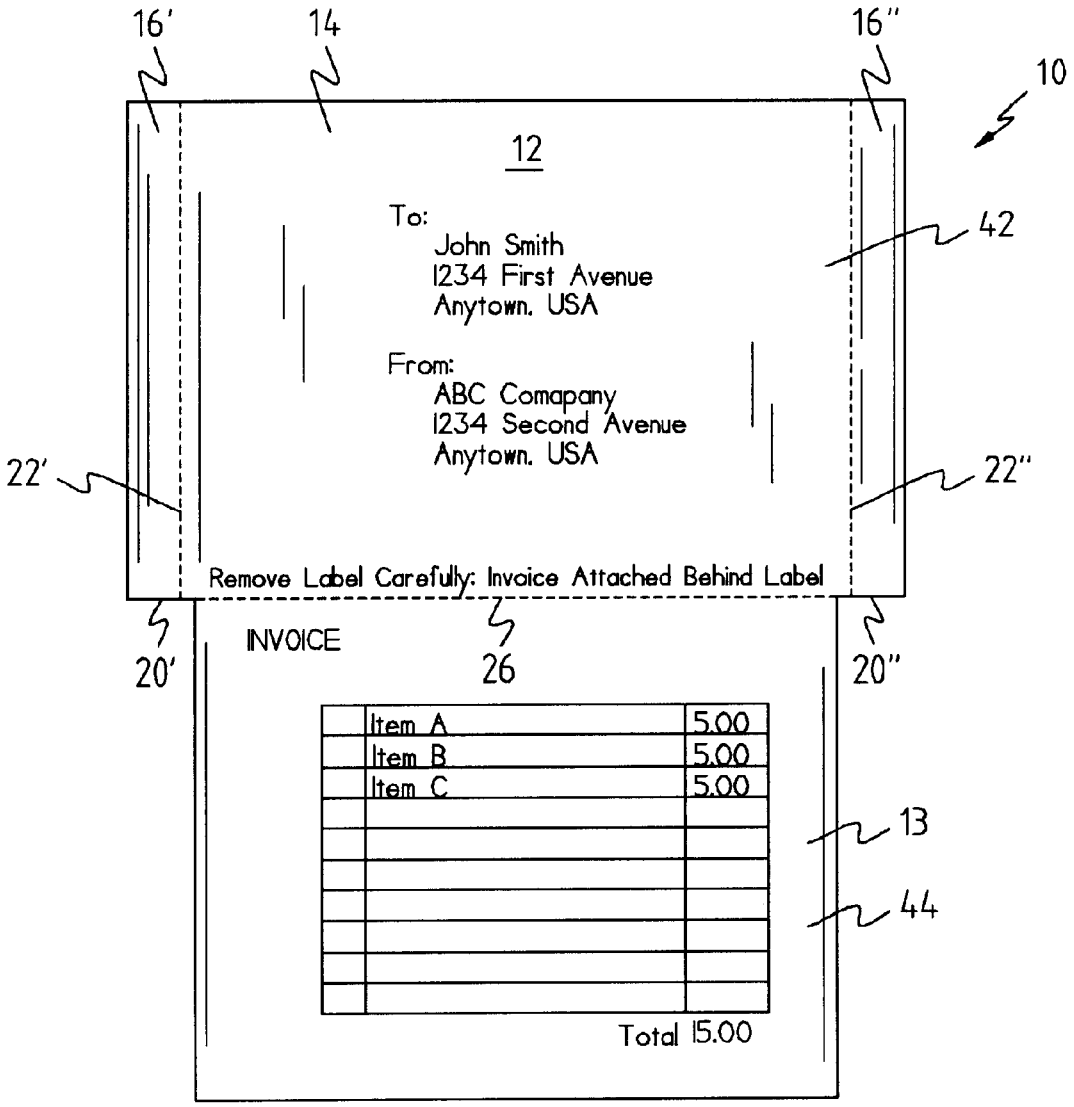
FIG. 4 is a plan view of the form shown after the invoice marginal strips have been removed.
Figure 5:
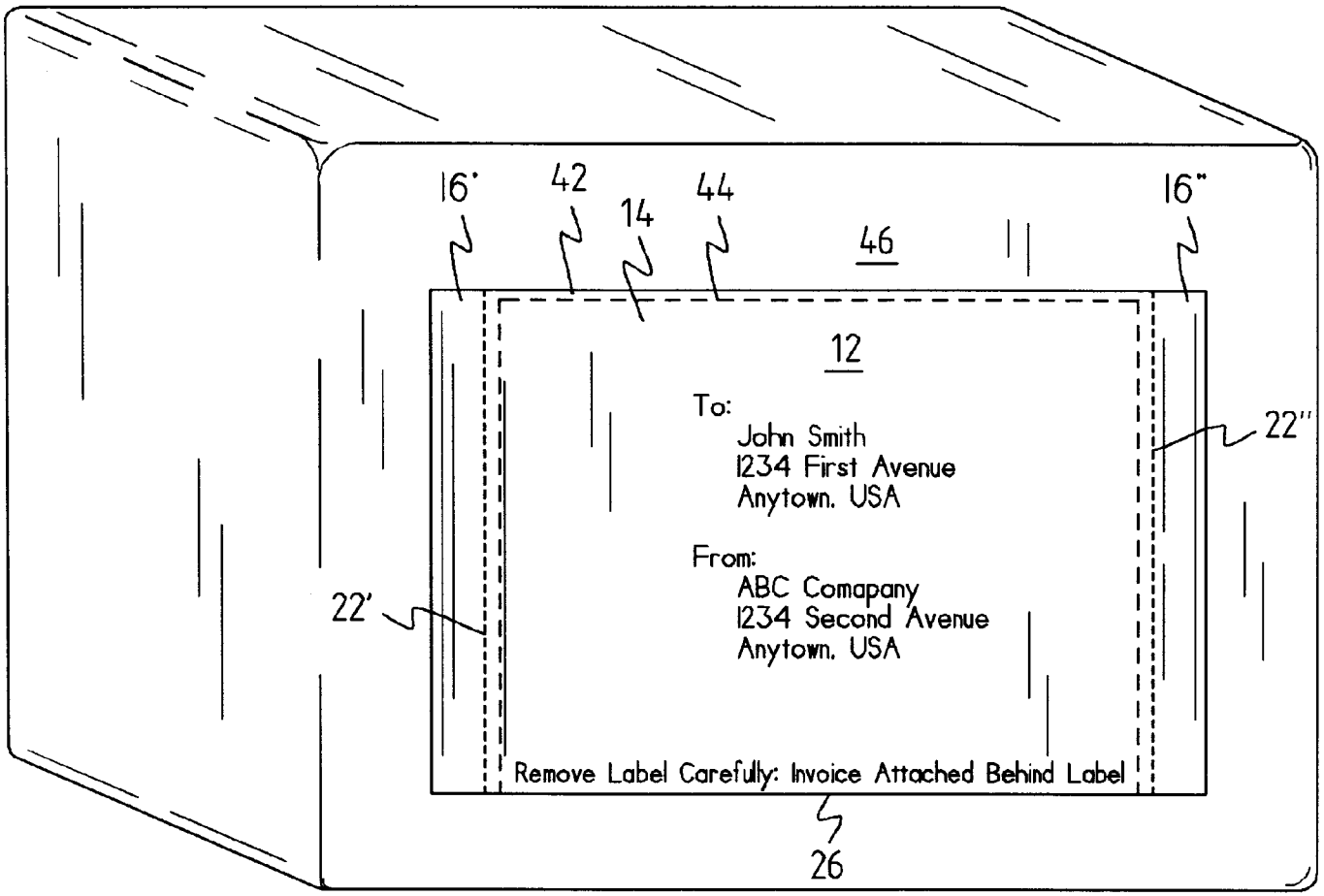
FIG. 5 is a perspective view of the form of the invention affixed to a package to be shipped, showing the form with the invoice section tucked behind the shipping label section.

Since both the shipping label and the invoice are integral to form 10, both may be printed at the same time in any type of printer (laser, inkjet, thermal, etc.) The form is then prepared for attachment to the package. The first step after printing, as shown in FIG. 3A, (which illustrates the back of the form), is to remove the marginal release liner strips 30' and 30". In FIG. 3A, release liner 30'", together with underlying marginal strip 18" is being separated from the invoice section along perforation 24". In FIG. 3B, release liner 30" is shown being peeled off the underside of marginal strip 16", and separated from the shipping label along liner slit or part 22", to reveal adhesive coating 38. Once the marginal release liners have been removed, the back of the form appears as shown in FIG. 3C. The front of the form, at this point, appears in plan view in FIG. 4. The next step, as shown in FIG. 3D, is to fold the invoice back toward (and behind) the shipping label along perforation 26, such that the release liner of the invoice contacts the release liner of the shipping label. The combination form is then ready to be attached to package 46, as shown in FIG. 5. The adhesive on the underside of marginal strips 16' and 16" functions to secure the combination form to package 46. Since the adhesive on the undersides of the shipping label and invoice is not used to secure the shipping label to the package, it should be appreciated that this adhesive is optional.

Figure 6A:
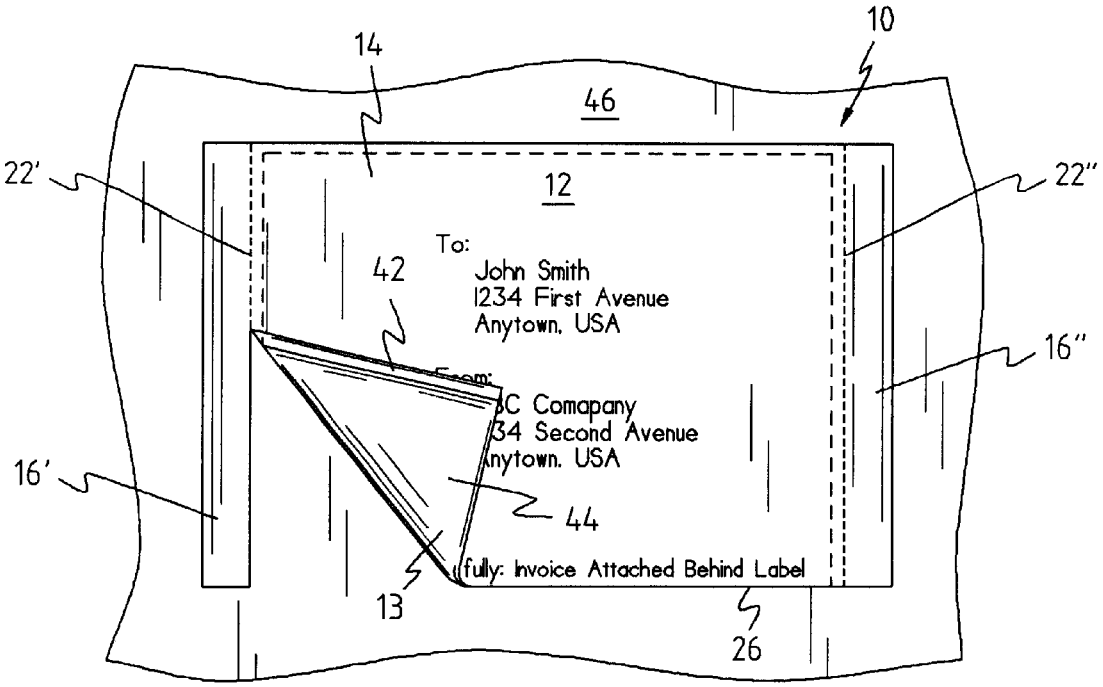
FIG. 6A is a view of the form of the invention being removed from the package.
Figure 6B:
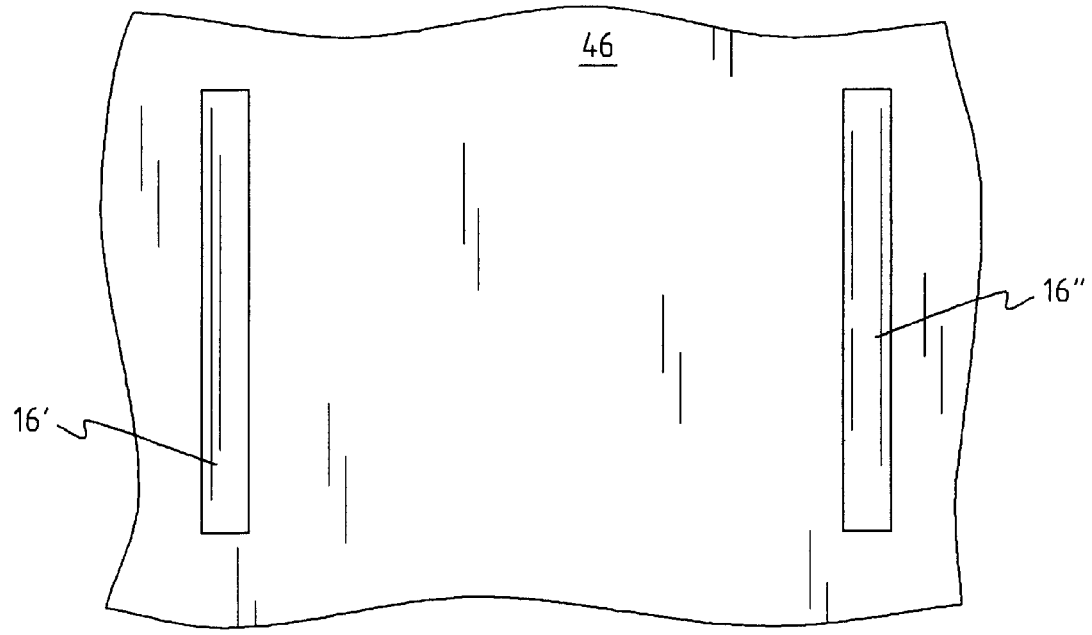
FIG. 6B is a view of the package after the form of the invention has been removed, showing only the adhesive backed marginal strips remaining on the package.
Figure 6C:
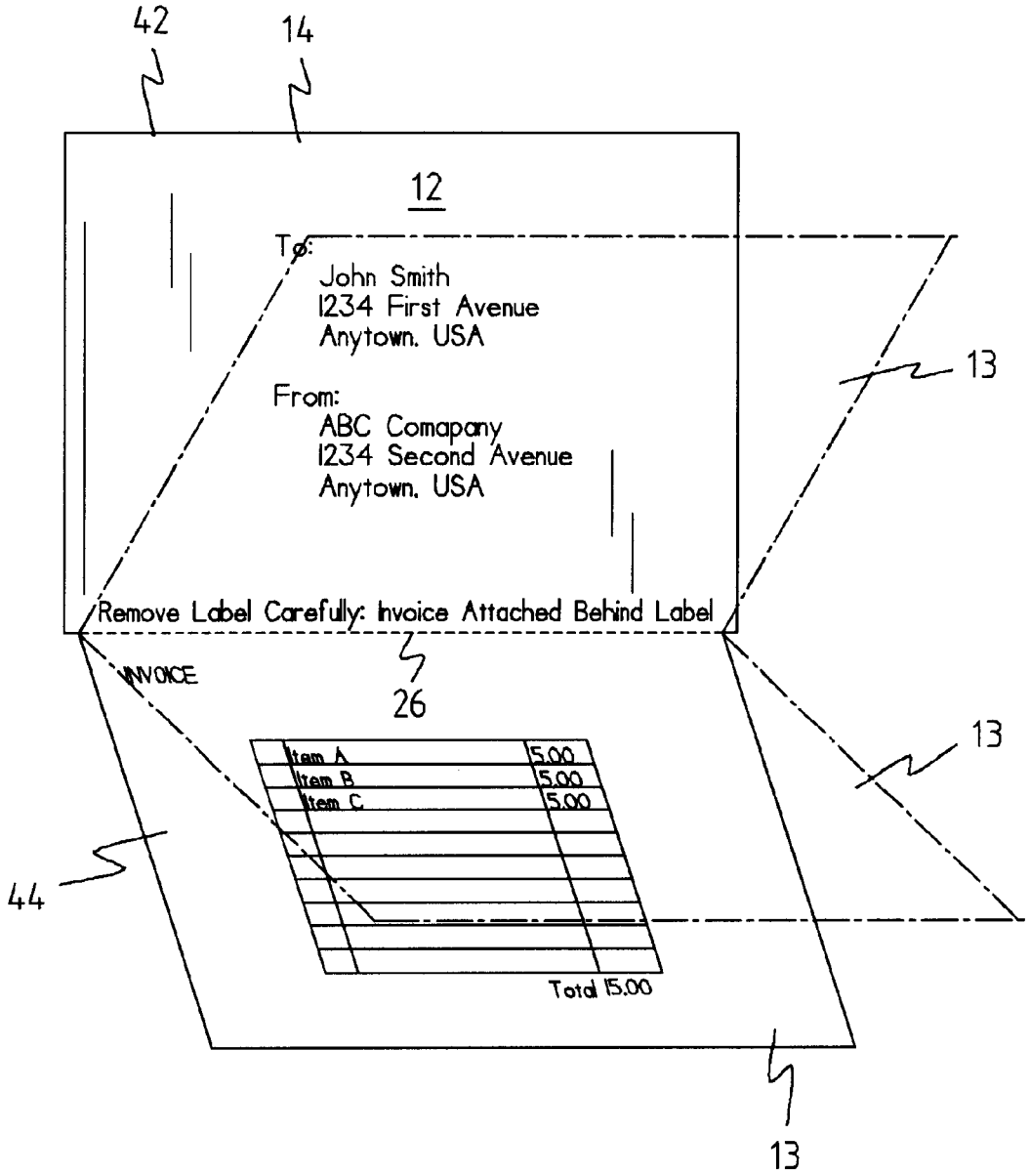
FIG. 6C is a view of the form of the invention after removal from the package, showing how the invoice is unfolded from behind the shipping label; and, FIG. 6D is a plan view of the form of the invention after it has been removed from the package and been unfolded.
Figure 6D:
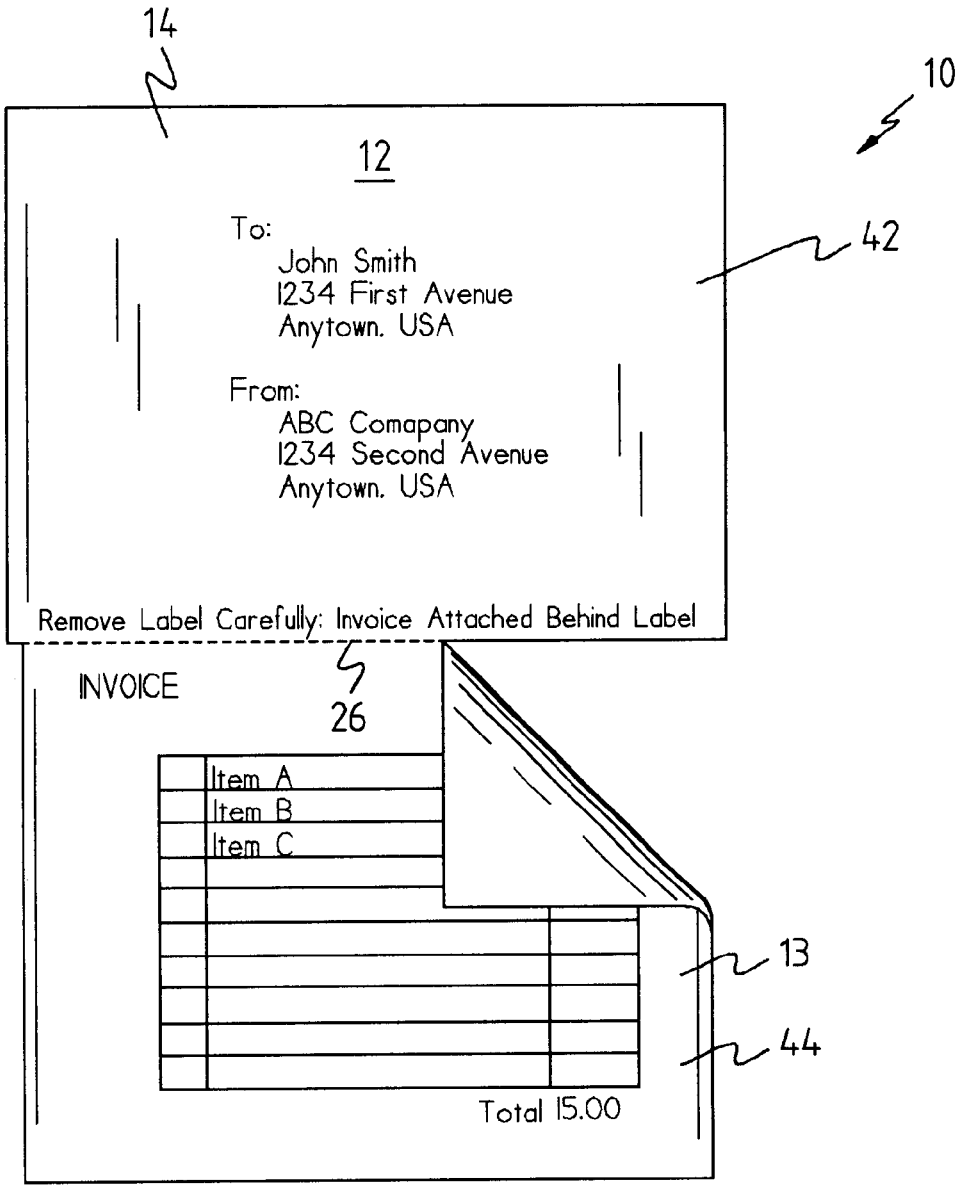

Upon receipt of the package by the recipient, the combination shipping label/invoice may be removed from the package by tearing along perforations 22' and 22" as shown in FIG. 6A. Optional printed indicia ("Remove Label Carefully: Invoice Attached Behind Label") warns the recipient that the invoice is tucked behind the shipping label. Once the combination form is removed, only marginal strips 16' and 16" remain on the package, as shown in FIG. 6B. The combination form may then be unfolded as shown in FIG. 6C, and the invoice detached from the shipping label as shown in FIG. 6D.

Thus, it is seen that the objects of the invention are efficiently obtained. However, it should also be apparent to those having ordinary skill in the art that changes can be made to the preferred embodiment of the invention as described herein without departing from the spirit and scope of the invention as claimed. For example, the terms "shipping label" and "invoice" are used herein to denote two different types of well-known business forms. However, it should be apparent that these terms are used herein merely to describe two different types of business forms. The invention as claimed, however, is intended to apply to any two different types of business forms. For example, the invention may comprise a packing slip and invoice, a shipping label and statement, or any other combination of two different forms.

What I claim is:

1. A bipartite combination shipping label/invoice form, comprising:

a first ply having an upper side and a lower side, said first ply comprising a shipping label section detachably secured along a dividing border to an invoice section, said shipping label section bordered at a first edge by a first marginal strip and at a second edge by a second marginal strip, said invoice section bordered by a third edge and a fourth edge, said shipping label section being wider between said first and second edges than said invoice section between said third and fourth edges, such that folding said invoice section along said dividing border and against said shipping label section results in said invoice section lying between said first and second edges of said shipping label section, where said lower side of said first and second marginal strips is coated with adhesive, said shipping label section and said invoice section comprising said bipartite form, and said shipping label section and said invoice section separated by a single fold which coincides with said dividing border; and, a second ply comprising a release liner detachably secured to said adhesive-coated underside of said first and second marginal strips.

2. A combination shipping label/invoice form as recited in claim 1 wherein said underside of said invoice section first ply is coated with adhesive, and wherein said second ply further comprises a release liner detachably secured to said adhesive-coated underside of said invoice section.

3. A bipartite combination shipping label/invoice form, comprising:

a shipping label section detachably secured along a dividing border to an invoice section, said shipping label section bordered at a first edge by a first marginal strip and at a second edge by a second marginal strip, said invoice section bordered by a third edge and a fourth edge, said shipping label section being wider between said first and second edges than said invoice section between said third and fourth edges, such that folding said invoice section along said dividing border and against said shipping label section results in said invoice section lying between said first and second edges of said shipping label section, where said lower side of said first and second marginal strips is coated with adhesive, said shipping label section and said invoice section comprising said bipartite form, and said shipping label section and said invoice section separated by a single fold which coincides with said dividing border.

4. A combination shipping label/invoice form, comprising:

a first ply having an upper side and a lower side, said first ply comprising a shipping label section detachably secured along a dividing border to an invoice section, said shipping label section bordered at a first edge by a first marginal strip and at a second edge by a second marginal strip, said invoice section bordered by a third edge and a fourth edge, said shipping label section being wider between said first and second edges than said invoice section between said third and fourth edges, such that folding said invoice section along said dividing border and against said shipping label section results in said invoice section lying between said first and second edges of said shipping label section, where said lower side of said first and second marginal strips is coated with adhesive, said first ply further comprising a third marginal strip detachably secured to said invoice section at said third edge and a fourth marginal strip detachably secured to said invoice section at said fourth edge; and, a second ply comprising a release liner detachably secured to said adhesive-coated underside of said first and second marginal strips.

5. A combination shipping label/invoice form, comprising:

a first ply having an upper side and a lower side, said first ply comprising a shipping label section detachably secured along a dividing border to an invoice section, said shipping label section bordered at a first edge by a first marginal strip and at a second edge by a second marginal strip, said invoice section bordered by a third edge and a fourth edge, said shipping label section being wider between said first and second edges than said invoice section between said third and fourth edges, such that folding said invoice section along said dividing border and against said shipping label section results in said invoice section lying between said first and second edges of said shipping label section, where said lower side of said first and second marginal strips is coated with adhesive, said first ply further comprising a third marginal strip detachably secured to said invoice section at said third edge and a fourth marginal strip detachably secured to said invoice section at said fourth edge, where said lower side of said third and fourth marginal strips are coated with adhesive; and, a second ply comprising a release liner detachably secured to said adhesive-coated underside of said first and second marginal strips, where said second ply release liner is detachably secured to said adhesive-coated underside of said third and fourth marginal strips.

6. A combination shipping label/invoice form, comprising:

a first ply having an upper side and a lower side, said first ply comprising a shipping label section detachably secured along a dividing border to an invoice section, said shipping label section bordered at a first edge by a first marginal strip and at a second edge by a second marginal strip, said invoice section bordered by a third edge and a fourth edge, said shipping label section being wider between said first and second edges than said invoice section between said third and fourth edges, such that folding said invoice section along said dividing border and against said shipping label section results in said invoice section lying between said first and second edges of said shipping label section, where said lower side of said first and second marginal strips is coated with adhesive; and, a second ply comprising a release liner detachably secured to said adhesive-coated underside of said first and second marginal strips, where said lower side of said shipping label section first ply is coated with adhesive, and wherein said second ply further comprises a release liner detachably secured to said adhesive-coated lower side of said shipping label section.

* * * * *